US010487700B2

(12) United States Patent
Berwinkl et al.

(10) Patent No.: US 10,487,700 B2
(45) Date of Patent: Nov. 26, 2019

(54) CAM SHAFT FOR A CAM SHAFT ARRANGEMENT

(71) Applicant: ECO Holding 1 GmbH, Marktheidenfeld (DE)

(72) Inventors: Andreas Berwinkl, Aichtal-Groetzingen (DE); Rene Heym, Gaefendorf (DE); Markus Todt, Oberboihingen (DE); Stephan Wanner, Muezenberg (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 34 days.

(21) Appl. No.: 15/904,330

(22) Filed: Feb. 24, 2018

(65) Prior Publication Data

US 2018/0274400 A1 Sep. 27, 2018

(30) Foreign Application Priority Data

Mar. 21, 2017 (DE) ..... 10 2017 105 995
Jan. 30, 2018 (DE) ..... 10 2018 101 972

(51) Int. Cl.
*F01L 1/344* (2006.01)
*F01L 1/047* (2006.01)

(52) U.S. Cl.
CPC ..... *F01L 1/34413* (2013.01); *F01L 1/047* (2013.01); *F01L 2001/0473* (2013.01)

(58) Field of Classification Search
CPC ..... F01L 1/34413; F01L 1/047; F01L 1/344; F01L 1/3442; F01L 1/46; F01L 2001/0473; F01L 2001/34423; F01L 2001/34433; F01L 2001/34469; F01L 2001/34479; F01L 2250/02
USPC ..... 123/90.17
See application file for complete search history.

(56) References Cited

U.S. PATENT DOCUMENTS 1,124,966 A * 1/1915 Stack ..... F16D 3/52 464/55
2012/0235518 A1* 9/2012 Hentsch ..... F01L 1/3442 310/37
2017/0183987 A1* 6/2017 Noguchi ..... F01L 1/3442

FOREIGN PATENT DOCUMENTS

DE 102008033230 A1 7/2009
DE 102012105284 A1 12/2013
DE 102015113356 A1 2/2017

* cited by examiner

*Primary Examiner* — Laert Dounis
*Assistant Examiner* — Kelsey L Stanek
(74) *Attorney, Agent, or Firm* — Von Rohrscheidt Patents

(57) ABSTRACT

A cam phaser for a cam shaft arrangement including an inner cam shaft and an outer cam shaft arranged concentrical relative to the inner cam shaft, the cam phaser including at least one rotor; at least one stator; and at least one compensation element configured to compensate axial and/or radial and/or angular tolerances, wherein the stator is connectable torque proof at least indirectly through a drive gear with the outer cam shaft and the rotor is connectable torque proof with the inner cam shaft, wherein the drive gear is separate from the stator and attachable torque proof at the outer cam shaft, wherein the stator is rotatably supportable on the inner cam shaft, wherein plural compensation elements are provided which are arranged evenly distributed in a circumferential direction, wherein the compensation elements are configured torsion stiff in the circumferential direction and attached between the stator and the drive gear.

11 Claims, 7 Drawing Sheets

CAM SHAFT FOR A CAM SHAFT ARRANGEMENT

RELATED APPLICATIONS

This application claims priority from and incorporates by reference German Patent Applications
DE 10 2017 105 995.4 filed on Mar. 21, 2017 and
DE 10 2018 101 972.6 filed on Jan. 30, 2018.

FIELD OF THE INVENTION

The invention relates to a cam phaser for a cam shaft arrangement with an inner cam shaft and an outer cam shaft arranged concentrical relative to the inner cam shaft wherein the cam phaser includes at least one rotor, at least one stator and at least one compensation element configured to compensate axial and/or radial and/or angular tolerances and wherein the stator is connectable torque proof at least indirectly through a drive gear with the outer cam shaft and the rotor is connectable torque proof with the inner cam shaft wherein the drive gear is separate from the stator and attachable torque proof on the outer cam shaft and the stator is rotatably supportable on the inner cam shaft. The invention furthermore relates to a cam shaft arrangement.

BACKGROUND OF THE INVENTION

It is well known to use cams whose position on the cam shaft is adjustable in particular for valve controlled internal combustion engines to provide a controlled variation of the valve timing of the internal combustion engine so that power and exhaust gas emission of the engine can be adapted. In order to adjust at least one cam an outer cam shaft in which a coaxially supported inner cam shaft is arranged is rotated relative to the inner cam shaft. Thus, the cams that are rotatably connected with the outer cam shaft but fixed at the inner cam shaft are moved relative to the cams that are fixed at the outer cam shaft. In order to adjust the cams relative to each other a rotor is used that is supported at a stator and that rotates the inner camshaft relative to the outer camshaft so that a phase shift of the valve timing is facilitated so that the opening times of the valves can be varied.

Double cam shaft systems of this type with an inner cam shaft and an outer cam shaft concentric thereto require improved tolerance compensation compared to systems with a single cam shaft since position variations can occur during operations and/or during assembly of the individual components of the cam phaser and of the cam shafts which are caused in particular by required tolerances that are inherent to the system. These imprecisions can lead to an increased friction and to a blocking of the individual components, in particular between the stator and the rotor.

DE 10 2008 033 230 A1 discloses e.g. a cam phaser for controlling a double cam shaft with a layer configuration with a first rotor shaped output element and a second rotor shaped output element which are arranged parallel to each other with their blade elements, wherein each output element is configured to receive at least one cam shaft of the double cam shaft so that a receiver protrudes laterally from the cam phaser adjustment center, wherein a compensation element is provided to align at least one output element relative to the double cam shaft in order to configure essential components of a valve train for internal combustion engines which include a cam shaft like a gas control valve control shaft with two cams that are adjustable relative to each other and which are in particular directly adjacent to each other. According to DE 10 2008 033 230 A1 the compensation element is a universal joint or a key.

DE 10 2012 105 284 A1 discloses a cam shaft arrangement with an inner cam shaft and an outer cam shaft and with a cam phaser wherein a compensation element is arranged between the inner cam shaft and a rotor of the cam phaser. The compensation element is disc shaped and includes a spherical contact surface for the inner cam shaft which includes a face that is configured accordingly.

DE 10 2015 113 356 A1 discloses an adjustable cam shaft with a cam phaser. The rotor of the cam phaser is centered about a rotation axis by a screw flange wherein a resilient element is arranged between the rotor and the screw flange wherein a torque is transferable through the resilient element while position errors are compensated.

BRIEF SUMMARY OF THE INVENTION

Thus, it is an object of the invention to improve a cam phaser for a cam shaft arrangement from a configuration and/or function point of view.

It is another object of the invention to improve a cam shaft arrangement from a configuration and function point of view.

A cam phaser for a cam shaft arrangement is proposed including an inner cam shaft and an outer cam shaft arranged concentrical relative to the inner cam shaft, the cam phaser including at least one rotor; at least one stator; and at least one compensation element configured to compensate axial and/or radial and/or angular tolerances, wherein the stator is connectable torque proof at least indirectly through a drive gear with the outer cam shaft and the rotor is connectable torque proof with the inner cam shaft, wherein the drive gear is separate from the stator and attachable torque proof at the outer cam shaft, wherein the stator is rotatably supportable on the inner cam shaft, wherein plural compensation elements are provided which are advantageously arranged evenly distributed in a circumferential direction, and wherein the compensation elements are configured torsion stiff in the circumferential direction and arranged and attached between the stator and the drive gear that is axially offset from the stator.

Double cam shaft systems require improved tolerance compensation compared to systems with a single cam shaft since imprecisions during production and assembly of the two cam shafts with each other can lead to binding or increased friction. The cam phaser which is advantageously a cam phaser of the vane type furthermore requires small gap tolerances, so that tolerance and shape deviations can lead to a substantial impairment of the function of the cam shaft arrangements.

According to the invention plural compensation elements are provided which are advantageously arranged evenly distributed in the circumferential direction, wherein the compensation elements are configured torsion proof in the circumferential direction and arranged and attached between the stator and the drive gear that is axially offset from the stator. The torsion proof configuration of the compensation elements facilitates a smooth torque transfer without clearance between the drive gear and the stator. By the same token the compensation elements can be configured flexible accordingly in all other directions so that axial and angular tolerance compensation is possible.

The separation of cam phaser and drive gear which is connected with a drive shaft of an internal combustion engine thus advantageously decouples the components. A variable interface is created which only requires an adaptation of the compensation element whereas the cam phasers are identical otherwise.

According to an advantageously embodiment of the invention the compensation elements are connected with the stator and the drive gear in a form locked or bonded manner. Thus, all connection techniques can be used that are known to a person skilled in the art. Separating the cam phaser and the drive gear facilitates a simple connection of the compensation elements with the cam phaser or the drive gear.

In a simple and cost effective manner the compensation elements can be respectively provided so that they are attachable at the stator and the drive gear with a threaded connection. Alternatively a welded connection can be used.

According to an advantageous embodiment of the invention the compensation elements are made from spring steel. A compensation element made from spring steel is particularly suitable for providing a flexible connection which facilitates a necessary tolerance compensation.

Advantageously the compensation elements respectively include a center attachment section that is provided for attachment at the stator and which is respectively adjoined at an end by an outer attachment section configured for attachment at the drive gear. This configuration facilitates an advantageous separation of the attachment sections.

According to an advantageous embodiment a respective wave shaped intermediary section is provided between the center attachment section and the outer attachment sections. The wave shaped intermediary section provides the option to adapt a flexibility of the compensation element to predetermined properties of a cam phaser.

The center attachment section can be advantageously attached at a cover element of the stator wherein the cover element includes radially configured attachment protrusions for arranging the center attachment section. The attachment protrusions facilitate simple assembly of the compensation element. Simultaneously a weakening of the cover element in the portion of the rotor can be prevented. Advantageously the attachment protrusions respectively include two bore holes for attaching the center attachment section wherein the bore holes are arranged on a first reference circle about the center axis of the cam phaser.

According to an advantageous embodiment of the invention the center attachment section respectively includes two bore holes for attachment at the cover element and a respective bore hole for attachment at the drive gear is arranged at the outer attachment section, wherein the bore holes of the center attachment section and the bore holes of the outer attachment sections are arranged on a common second reference circle which is identical with the first reference circle. Thus, the force flow during torque transmission between the drive gear and the stator can be optimized.

The rotor is advantageously connected by a central bolt with the inner cam shaft. According to an embodiment of the invention a connector can be connected between a central bolt and the rotor.

Furthermore a cam shaft arrangement is proposed that includes an inner cam shaft and an outer cam shaft that is arranged concentric to the inner cam shaft, a drive gear attached on the outer cam shaft and a cam phaser.

BRIEF DESCRIPTION OF THE DRAWINGS

Further advantages can be derived from the subsequent drawing description. The drawing illustrates embodiments of the invention. The drawing, the description and the claims include numerous features in combination. A person skilled in the art will also view the features the features individually and combine them into additional useful combinations, wherein:

DETAILED DESCRIPTION OF THE INVENTION

Figure 1:
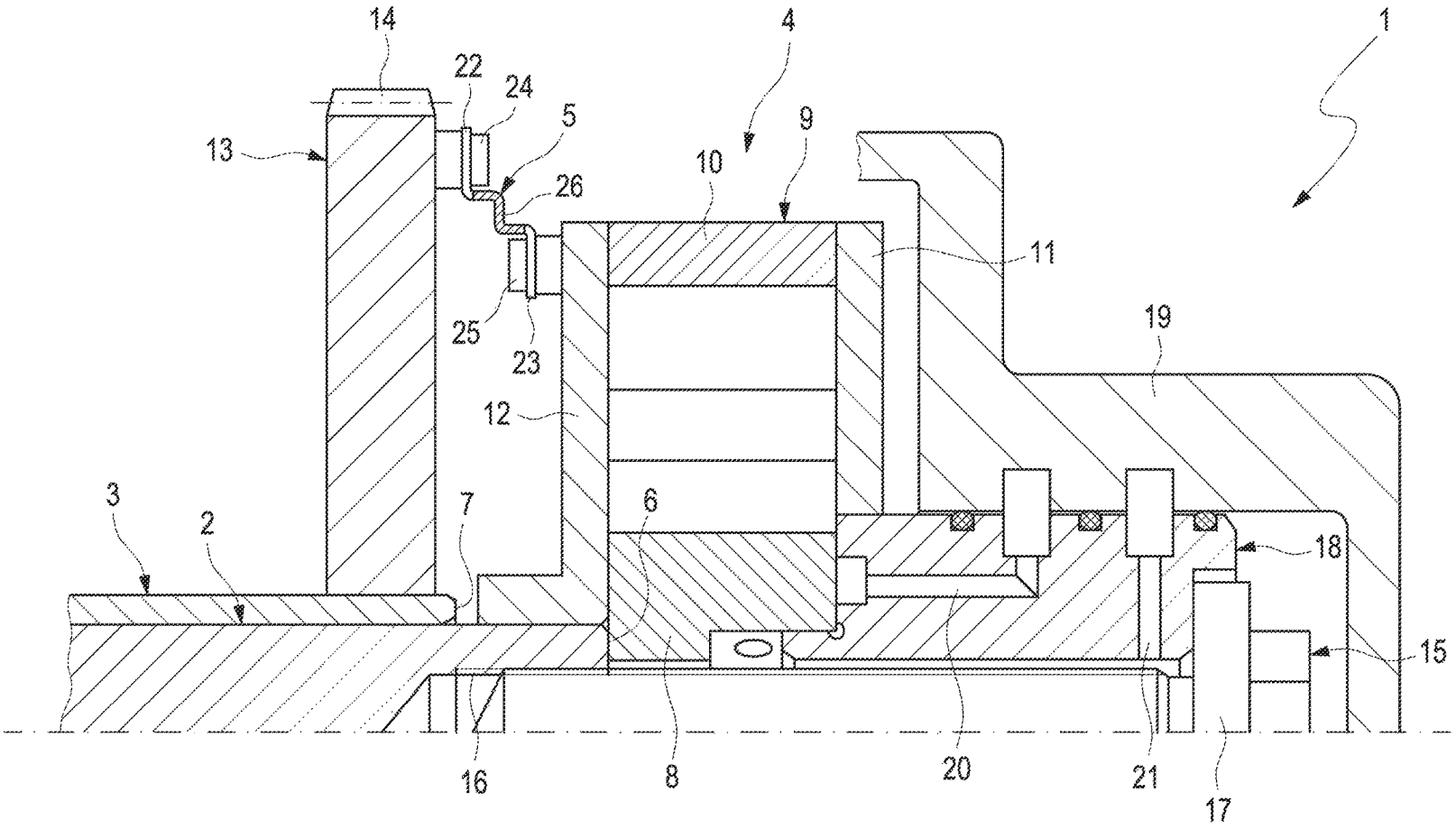
FIG. 1 illustrates a cam shaft arrangement with two coaxial cam shafts, a cam phaser, a drive gear and a compensation element in a sectional view.

FIG. 1 illustrates a detail of a cam shaft arrangement 1 with two coaxial cam shafts 2, 3 a cam phaser 4 and plural compensation elements 5 in a sectional view. The cam shaft arrangement 1 includes an inner cam shaft 2 and an outer cam shaft 3, wherein the inner cam shaft 2 is a solid shaft and the outer cam shaft 3 is a hollow shaft. The inner cam shaft 2 is arranged within the outer cam shaft 3 so that the cam shafts 2, 3 are arranged concentric and coaxial with each other. The cam shafts 2, 3 which can form a central cam shaft for an internal combustion engine respectively include cams and are rotatable relative to each other within limits. The cam shafts 2, 3 can form a central cam shaft for an internal combustion engine. A rotation of the cam shafts 2, 3 relative to each other in this case causes a movement of inlet and outlet timing between "early" and "late". By the same token the cam shafts 2, 3 can form one of two cam shafts for an internal combustion engine. A rotation of the am shafts 2, 3 relative to each other that causes an extension or a shortening of the inlet or outlet control timing.

The cam shafts 2, 3 respectively include an end 6, 7 that is oriented towards the cam phaser 4, wherein the end 6 of the inner cam shaft 2 protrudes towards the cam phaser 4 relative to an end of the outer cam shaft 7.

The cam phaser 4 which is configured as a vane phaser includes a rotor 8 and a stator 9 which are rotatable relative to each other within limits. In the illustrated embodiment the stator 9 includes a cylindrical stator base element 10 and two cover elements 11, 12 that are sealed on the stator base element and attached by bolt elements 34. The stator 9 is at least indirectly connected through a drive gear 13 with the outer cam shaft 3. The drive gear 13 is connected with a non-illustrated crank shaft which forms the drive shaft of the internal combustion engine. For this purpose the drive gear includes an external teething 14. Alternatively the drive gear can be configured as a cog wheel or a sprocket gear. As evident from FIG. 1 the drive gear 13 is connected torque proof with the outer cam shaft 3.

The rotor 8 of the cam phaser 4, however, is connected torque proof with the inner cam shaft 2 which as described supra extends beyond the outer cam shaft 3. In order to connect the rotor 8 with the inner cam shaft 2 a central bolt 15 is provided which is threaded into a bore hole 16 of the inner cam shaft 2. A bolt head 17 of the central bolt 15 thus clamps the rotor 8 with a connection element 18 clamped there between in the axial direction against the end 6 of the inner cam shaft 2. The connector 18 that is rotatably supported in a housing 19 and sealed includes indicated hydraulic channels 20, 21 for controlling the cam phaser 4.

Double cam shaft systems with an inner and outer cam shaft 2, 3 requires improved tolerance compensation compared to systems with a single cam shaft since imprecisions during fabrication and assembly of the two cam shafts 2, 3 relative to each other can lead to binding or increased friction. The cam phaser 4 thus requires small gap tolerances so that tolerance, shape and position deviations can lead to a substantial impairment of the function of the cam shaft arrangements.

In order to compensate for axial and angular tolerances the cam shaft arrangement 1 includes at least plural compensation elements 5 that are evenly distributed in the circumferential direction.

The compensation elements 5 are configured torsion stiff in the circumferential direction and arranged in the axial direction between the drive gear 5 and the cover element 12 of the stator 9 which cover element is arranged on a left side in the drawing figure. Thus, a form locking or bonded attachment (e.g. bolting or welding) is conceivable. An exemplary threaded connection is illustrated between the compensation element 5 and the cover element 12 or the drive gear 13. Thus, the compensation element 5 respectively includes a bolting grommet 22, 23 at its ends wherein the bolting grommet is respectively attached by a bolt element 24, 25 at the cover element 12 or the drive gear 13.

The compensation element 5 is advantageously configured from spring steel which is particularly suitable for providing a flexible connection which allows for the necessary tolerance compensation. By the same token a torque can be safely transmitted without clearance between the drive gear 13 and the cover element 12.

The bolting grommets 22, 23 of the compensation element 5 are connected by a bar 26 whose shape facilitates a separation of the drive gear 13 and the cover element 12 in the axial direction. This separation of cam phaser 4 and drive gear 12 facilitates decoupling the components so that a variable interface is provided which only requires an adaptation of the cover element 5 while the cam phaser 4 remains identical otherwise. The illustrated embodiment includes a bar 26 with a shoulder.

Another embodiment of the invention is illustrated in more detail in FIGS. 2-11. Identical or like components are provided with identical reference numerals. With respect to the general description of the configuration reference is made to the description of the first embodiment.

Figure 9:
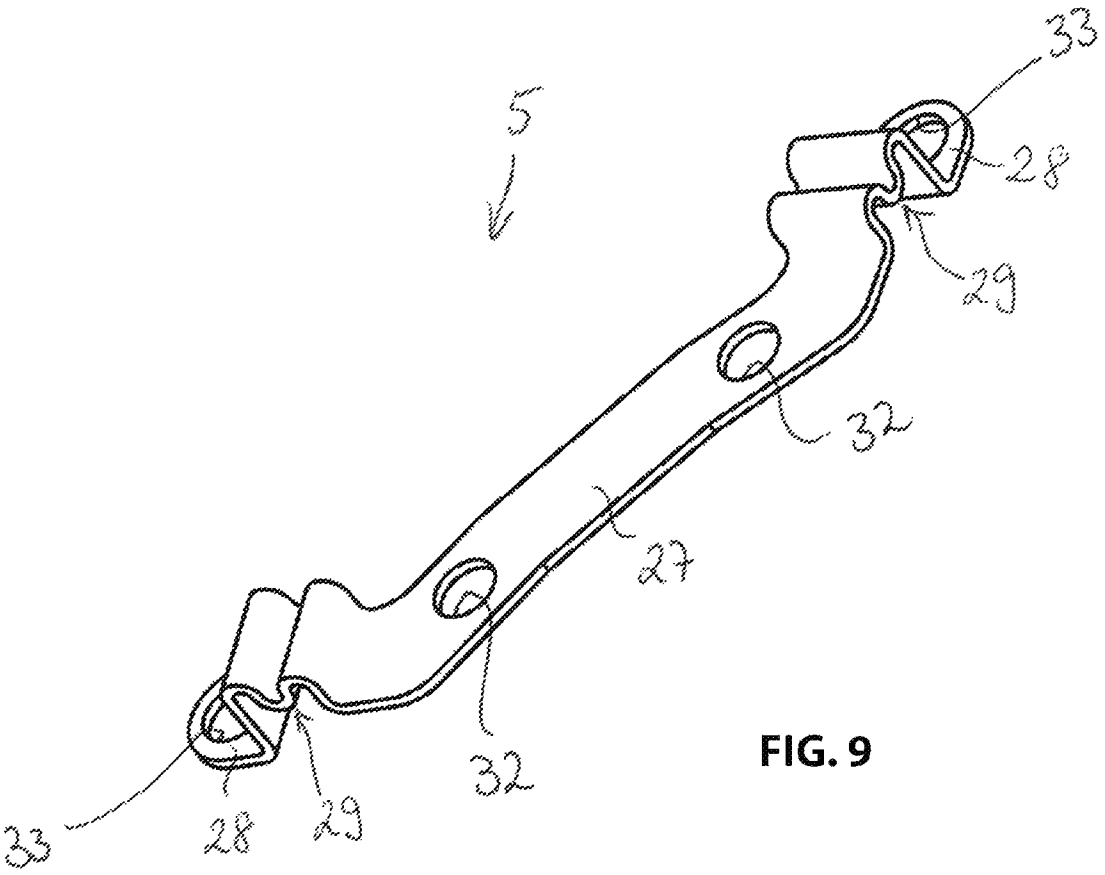
FIG. 9 illustrates an enlarged perspective view of the compensation element of the cam phaser according to FIG. 2.
Figure 11:
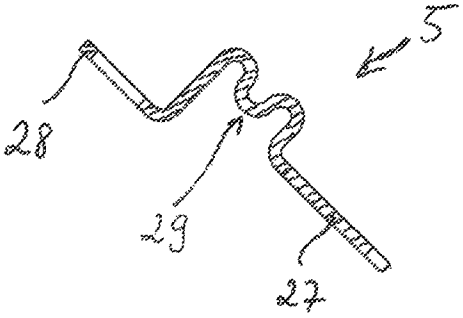
FIG. 11 illustrates a sectional view along the line A-A of the compensation element according to FIG. 10.
Figure 10:
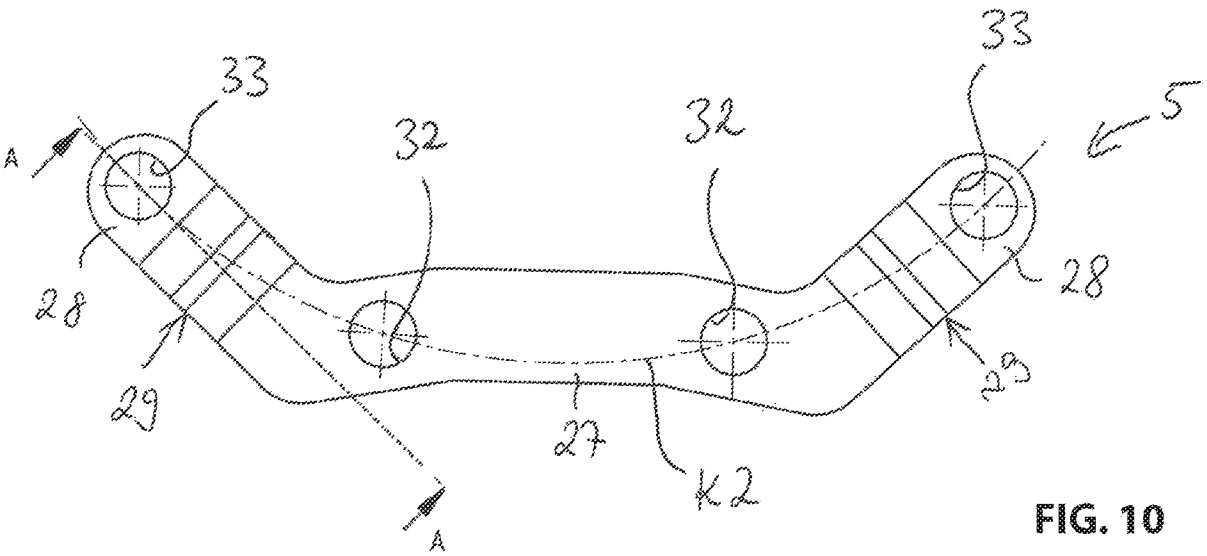
FIG. 10 illustrates a front view of the compensation element according to FIG. 9.

FIGS. 9-11 thus illustrate one of the identically configured compensation elements 5 in an enlarged representation and partially in a sectional view. It is evident that the compensation element 5 includes a center attachment section that is provided for attachment at the stator 9 and which is respectively adjoined at one end by an outer attachment section 28 for attachment at the drive gear 13. The attachment sections 27, 28 are thus advantageously separated from each other which significantly simplifies assembly.

Between the center attachment section 27 and the outer attachment sections 28 a respective wave shaped intermediary section 29 is provided which has the option to adapt a flexibility of the compensation element 5 to the predetermined properties of a cam phaser 4 by adaptation of the shaft profile.

Figure 2:
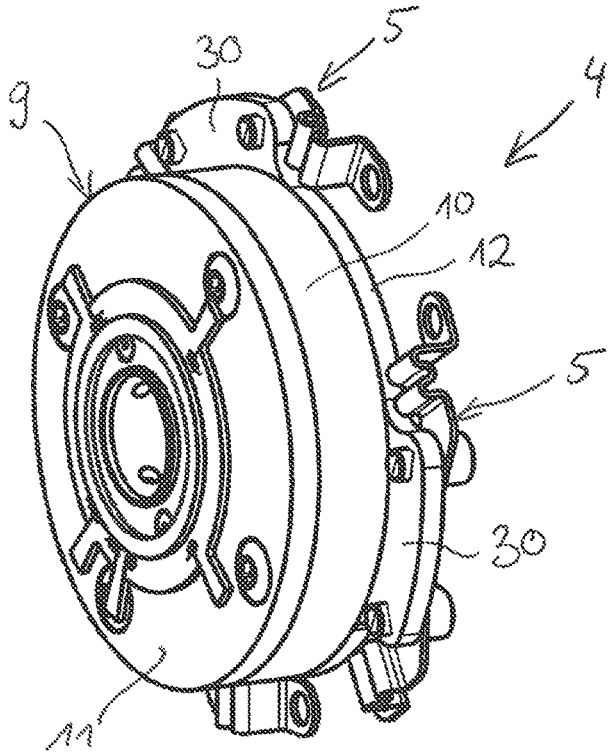
FIG. 2 illustrates another embodiment of a cam phaser with a compensation element in a first perspective view.
Figure 3:
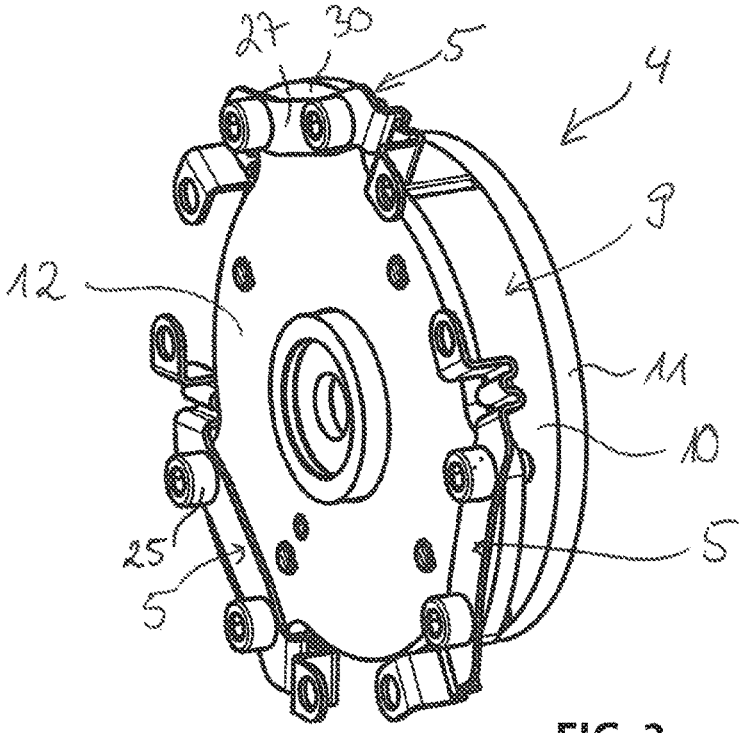
FIG. 3 illustrates a rear view of the cam phaser according to FIG. 2 in a second perspective view.
Figure 5:
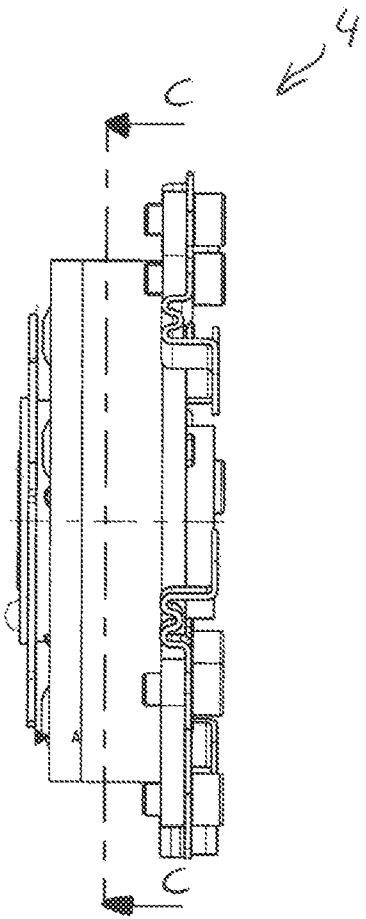
FIG. 5 illustrates a side view of the cam phaser according to FIG. 2.
Figure 6:
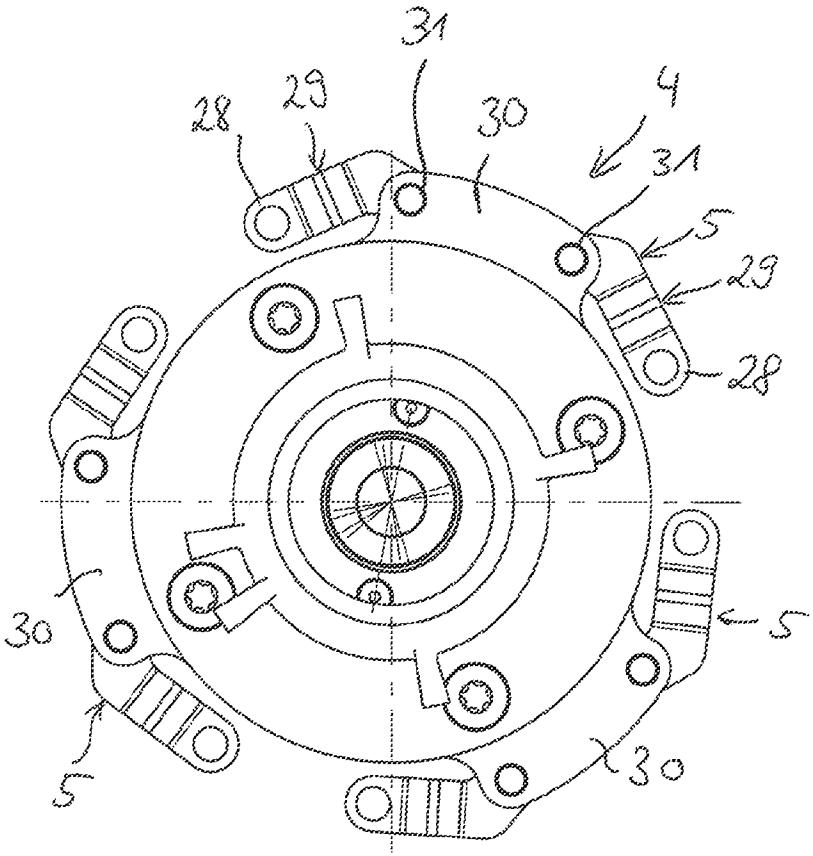
FIG. 6 illustrates a front view of the cam phaser according to FIG. 2.
Figure 8:
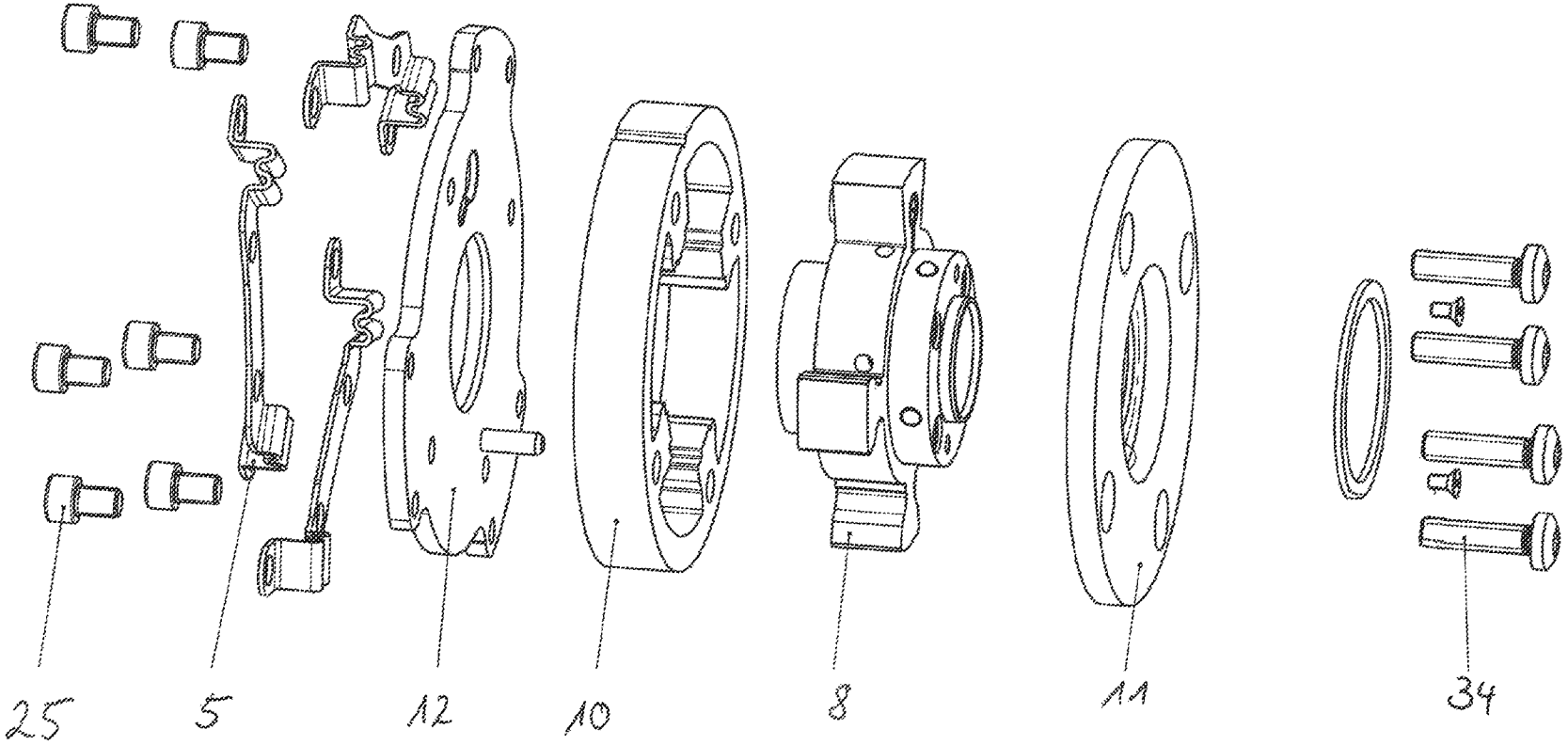
FIG. 8 illustrates an exploded view of the cam phaser according to FIG. 2.

As evident in particular from FIGS. 2, 3 and 6 the center attachment section is attached at the cover element 12 of the stator 9, the so called locking disc, wherein the cover element 12 includes radially configured attachment protrusions 30 for arranging the center attachment section 27. The attachment protrusions 30 facilitate simple assembly of the compensation elements 5. This applies in particular for the attachment of the compensation elements 5 at the locking disc and for the attachment at the non-illustrated drive gear 13. The intermediate sections 29 and the outer attachment sections extend beyond the attachment protrusions 30 and respectively extend in different circumferential directions after being mounted at the stator 9 which is evident in particular from FIG. 6.

In order to compensate axial and angular tolerances the cam phaser 4 according to the second embodiment includes three compensation elements 5 that are evenly distributed in the circumferential direction. An even distribution of only two or more than more than three compensation elements 5 is also conceivable. Thus, the arrangement of the compensation elements 5 influences force flow during torque transmission.

Figure 4:
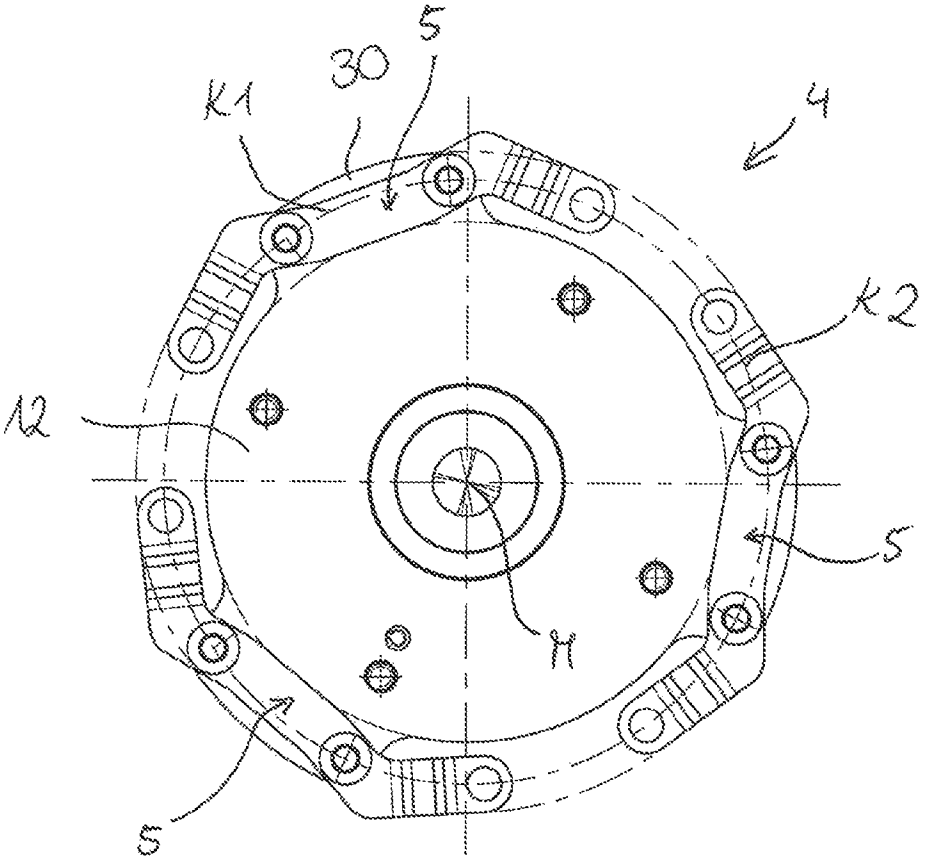
FIG. 4 illustrates a rear view of the cam phaser according to FIG. 2.
Figure 7:
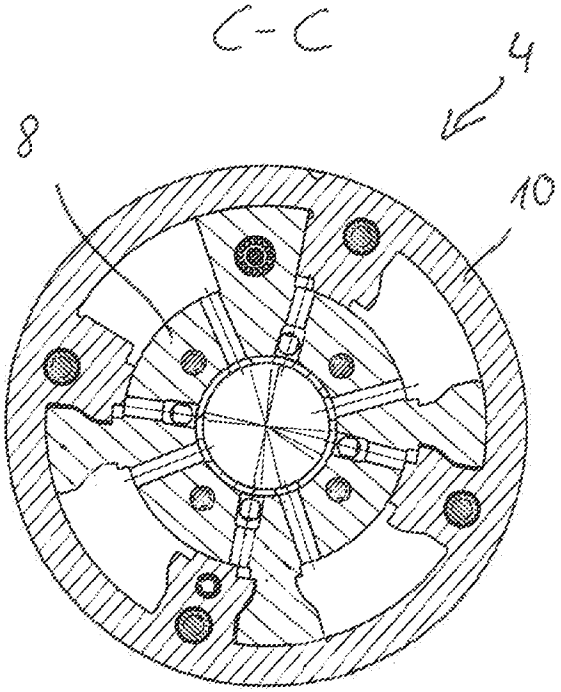
FIG. 7 illustrates a cross section C-C of the cam phaser according to FIG. 2.

The attachment protrusions 30 of the locking disc respectively include 2 bore holes 31 for attaching the center attachment sections 27 which are arranged on a first reference circle K1 about the center axis M of the cam phaser 4 illustrated in FIG. 4.

By the same token the center attachment section 27 respectively includes two corresponding bore holes 32 for attachment at the cover element 12 and a respective bore hole 33 is attached at the outer attachment section 28 for attachment at the drive gear 13 wherein the bore holes 32 of the center attachment section 27 and the bore holes 33 of the outer attachment section 28 are arranged on a common second reference circle K2 which is identical with the first reference circle K1. Thus force flow can be optimized during torque transmission between the drive gear 13 and the stator 9.

What is claimed is:

1. A cam phaser for a cam shaft arrangement including an inner cam shaft and an outer cam shaft arranged concentrical relative to the inner cam shaft, the cam phaser comprising:

at least one rotor;

at least one stator; and at least one compensation element configured to compensate axial or radial or angular tolerances, wherein the at least one stator is connectable torque proof at least indirectly through a drive gear with the outer cam shaft and the at least one rotor is connectable torque proof with the inner cam shaft, wherein the drive gear is separate from the at least one stator and attachable torque proof at the outer cam shaft, wherein the at least one stator is rotatably supportable on the inner cam shaft, wherein plural compensation elements are provided which are arranged evenly distributed in a circumferential direction, wherein the compensation elements are configured torsion stiff in the circumferential direction and arranged and attached between the at least one stator and the drive gear that is axially offset from the at least one stator, and wherein the compensation elements are connected form locked or bonded with the at least one stator and the drive gear.

2. A cam phaser for a cam shaft arrangement including an inner cam shaft and an outer cam shaft arranged concentrical relative to the inner cam shaft, the cam phaser comprising:

at least one rotor;

at least one stator; and at least one compensation element configured to compensate axial or radial or angular tolerances, wherein the at least one stator is connectable torque proof at least indirectly through a drive gear with the outer cam shaft and the at least one rotor is connectable torque proof with the inner cam shaft, wherein the drive gear is separate from the at least one stator and attachable torque proof at the outer cam shaft, wherein the at least one stator is rotatably supportable on the inner cam shaft, wherein plural compensation elements are provided which are arranged evenly distributed in a circumferential direction, wherein the compensation elements are configured torsion stiff in the circumferential direction and arranged and attached between the at least one stator and the drive gear that is axially offset from the at least one stator, and wherein the compensation elements are configured from spring steel.

3. A cam phaser for a cam shaft arrangement including an inner cam shaft and an outer cam shaft arranged concentrical relative to the inner cam shaft, the cam phaser comprising:

at least one rotor;

at least one stator; and at least one compensation element configured to compensate axial or radial or angular tolerances, wherein the at least one stator is connectable torque proof at least indirectly through a drive gear with the outer cam shaft and the at least one rotor is connectable torque proof with the inner cam shaft, wherein the drive gear is separate from the at least one stator and attachable tome proof at the outer cam shaft, wherein the at least one stator is rotatable supportable on the inner cam shaft, wherein plural compensation elements are provided which are arranged evenly distributed in a circumferential direction, wherein the compensation elements are configured torsion stiff in the circumferential direction and arranged and attached between the at least one stator and the drive gear that is axially offset from the at least one stator, and wherein the compensation elements respectively include a center attachment section provided for attachment at the stator, and wherein the center attachment section is adjoined at an end by a respective outer attachment section for attachment at the drive gear.

4. The cam phaser according to claim 3, the compensation elements are respectively attached at the at least one stator and at the drive gear by a threaded connection.

5. The cam phaser according to claim 3, wherein a respective wave shaped intermediary section is arranged between the center attachment section and the respective outer attachment section.

6. The cam phaser according to claim 3, wherein the center attachment section is attached at a cover element of the stator, and wherein the cover element includes radially configured attachment protrusions configured to arrange the center attachment section.

7. The cam phaser according to claim 6, wherein the attachment protrusions respectively include two first bore holes for attaching the center attachment section, and wherein the two first bore holes are arranged on a first reference circle about the center axis of the cam phaser.

8. The cam phaser according to claim 7, wherein the center attachment section includes two second bore holes for attachment at the cover element and a third bore hole is provided at the respective outer attachment section for attachment at the drive gear, wherein the two second bore holes of the center attachment section and the third borehole of the respective outer attachment section are arranged on a common second reference circle which is identical with the first reference circle.

9. The cam phaser according to claim 3, wherein the at least one rotor is connectable with the inner cam shaft by a central bolt.

10. The cam phaser according to claim 9, wherein the at least one rotor is connectable with the inner cam shaft through a connector by the central bolt.

11. A cam shaft arrangement, comprising:

an inner cam shaft;

an outer cam shaft arranged concentric to the inner cam shaft;

a drive gear attached at the outer cam shaft; and a cam phaser according to claim 3.

* * * * *